United States Patent [19]

Stiles

[11] Patent Number: 4,844,243

[45] Date of Patent: Jul. 4, 1989

[54] HOLDER FOR BAKED GOODS AND THE LIKE AND METHOD OF ARRANGING SAME

[76] Inventor: Delores Stiles, 8276 Manchester Dr., Grand Blanc, Mich. 48439

[21] Appl. No.: 187,356

[22] Filed: Apr. 28, 1988

[51] Int. Cl.[4] ..... B65D 5/50

[52] U.S. Cl. ..... 206/44 R; 206/527; 206/45.14; 206/558; 220/23.8; 426/119; 426/120

[58] Field of Search ..... 206/44, 45.14, 527, 206/1.8, 19, 558; 220/23.8; 99/428; 426/119, 120

[56] References Cited

U.S. PATENT DOCUMENTS 3,844,525 10/1974 Parmett ..... 220/23.8

4,002,773 1/1977 Entenmann ..... 206/45.19

4,314,650 2/1982 Cillario ..... 426/120

*Primary Examiner*—Stephen Marcus

*Assistant Examiner*—Gilbert W. Reece

*Attorney, Agent, or Firm*—Krass & Young

[57] ABSTRACT

The present invention is a tray for holding multiple individual confectionery items in a pleasing array for use in displaying the confectionery items. The tray is composed of a number of cavities, and possesses attachment points which, when connected by flexible bands, cause the tray to bulge creating an elevated platform on which the confectionery items can be displayed by being placed in the cavities. Empty cavities can be filled with confectionery items or filler segments which can be also pleasingly decorated.

7 Claims, 2 Drawing Sheets

HOLDER FOR BAKED GOODS AND THE LIKE AND METHOD OF ARRANGING SAME

FIELD OF THE INVENTION

This invention pertains to a novel holder for baked goods, such as cupcakes, and a system for creating a predetermined design in an array of such baked goods located in the holder.

BACKGROUND OF THE INVENTION

Trays, tins and pans for the mixing, baking and serving of various cakes are well-known in the art. Likewise, compartmented trays for the preparation, shipping, display and service of foods are likewise well-known. In the field of arranging of food products for service, such as at parties and the like, a number of methods have been adopted for the service of individual baked goods, such as cupcakes. Often, such cakes are arrayed in an aesthetically pleasing pattern on a flat tray or plate, or placed in a fixed holder such as an ice cream cone, a drinking cup or a collection of cups. In the past, it has been known to utilize temporary or permanent fastening means to hold together a series of drinking cups in a predetermined pattern, and utilizing the openings in said drinking cups to receive previously prepared baked goods, such as cupcakes. This method has not been altogether satisfactory for a number of reasons. First, the assembly of such holder is a tedious and time consuming process. The assembly of such a display device is a very work intensive project. Secondly, unless the holders are well secured, the display has a tendency to collapse under the weight of the baked goods which are placed in the collected holders. Finally, this method and apparatus allow no predetermined pattern in the holder to be established easily. Rather, the placement of various individual cake components in the tray holder is a random or trial and error method, and several attempts are often required to create an aesthetically pleasing pattern in the completed display.

The present invention is designed to overcome these limitations.

DETAILED DESCRIPTION OF THE DRAWINGS

DESCRIPTION OF THE PREFERRED EMBODIMENT

Figure 1:
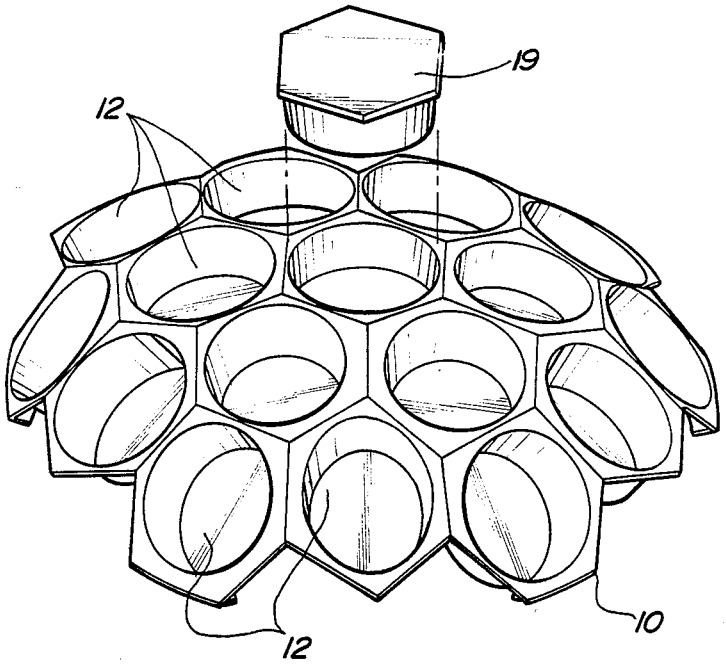
FIG. 1 is a perspective view of the invention in its empty configuration.

In a first preferred embodiment, a tray 10, preferably of flexible vacuum moldable plastic is designed as a single unitary piece, in which a number of cavities 12 are disposed in a predetermined, fixed pattern. The tray 10 contains a number of cavities 12. Although in the preferred embodiment, the entire tray 10 is molded of a transparent plastic material, it is possible to manufacture the tray 10 in a variety of colors, ensuring only that the bottom surface of each cavity has at least some transparent portion. Each cavity 12 is designed to accommodate one or more display items, such as baked goods 18, or a filler segment 19. The filler segment 19 is designed so as to be a suitable location for the mounting of a small figurine, such as the bride and groom in a wedding cake, or a two-dimensional design. In this fashion, the baked goods 18 or other items which are placed for display in the tray may be interspersed with premanufactured designed items to add to the aesthetics of the overall completed display.

In this first preferred embodiment, the tray 10 is shaped into a three-dimensional object which approximates the shape of a portion of the outer shell of the surface of a hollow sphere. When placed on a flat serving table, the completed display presents a dome-like appearance which is pleasing to the eye. When viewed from the side, the upper surface of the openings of the cavities define a generally spherical segment.

In this first preferred embodiment, there are a large number of cavities 12 provided in each tray. The smallest tray 10 may have as few as 18 cavities 12, while larger trays 10 may have as many as 100 cavities 12. An important aspect of the invention is the ability to easily create an aesthetically pleasing design utilizing items which are placed in the cavities 12.

Figure 2:
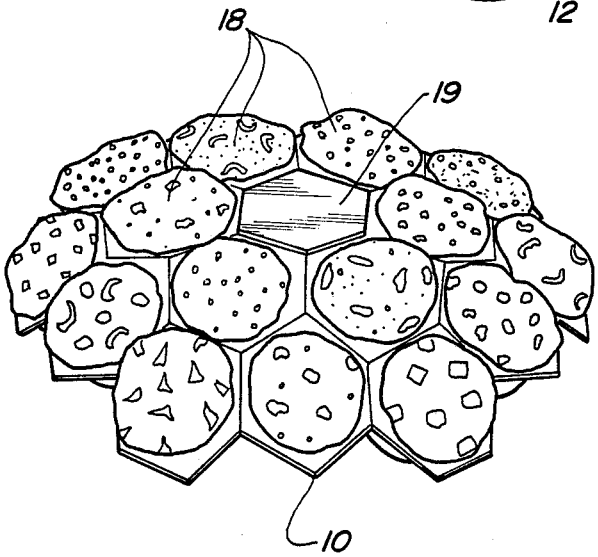
FIG. 2 is a perspective view of the invention is use, showing the display of baked goods in an aesthetically pleasing fashion.

By way of example, referring now to FIG. 2, a series of cupcakes is prepared utilizing different colors of icing. A quantity of cakes may be prepared with a white icing, a second quantity prepared with a red icing and a third quantity prepared with a green icing. Utilizing the proper design, these cakes may be arrayed on the tray in the necessary pattern to give an overall appearance of, for example, a Christmas wreath. Because of the large number of cavities 12 in the tray 10, and the associated large number of variations which might be achieved in placement, it is desirable to establish a pattern by which the individual installing the cakes in the tray 10 may quickly and easily arrange the cakes on the tray 10 in one operation, without the time consumed by the trial and error method.

Figure 3:
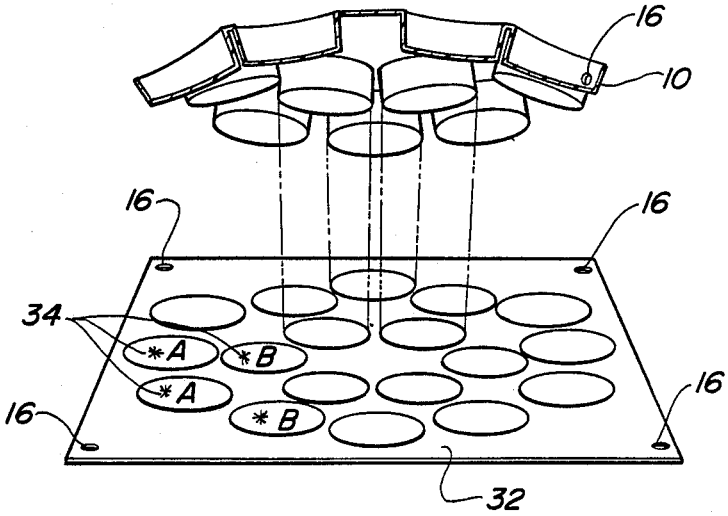
FIG. 3 is a perspective view of the tray portion of the invention in relation to the key, showing the utilization of the key to guide the placement of baked goods in the proper location within the tray.

To this end, with reference to FIG. 3, the invention embodies the use of a series of keys 32 on which are imprinted a number of symbols 34. In the preferred embodiment, there are a number of keys 32 which are utilized to establish a collection of arrangements for the person arranging the cakes in the holder. Each individual key 32 represents a separate and distinct pattern. In a second embodiment, each symbol 34 may constitute a coded letter or number. These letters and numbers are, accordingly, arranged to correspond to a series of designs in a reference book. In this fashion, a single key may be utilized as a basis for a wide variety of patterns.

Still, referring to FIG. 3, it can be seen that the method herein described contemplates that the user of the invention will place the tray 10 directly on top of the key 32, which is usually in the form of a sheet of paper or cardboard. Each tray 10 is marked with two or more fixed key locations 16, which correspond to fixed key locations 16 on the key 32. This ensures that the tray will always be placed in proper orientation in respect to the key. The viewer is then able to observe, through the transparent portion of the body of each cavity, the symbol corresponding to each cavity on the key. By application of a preprinted set of instructions corresponding to said tray 10 and key 32, the user is instructed as to the placement of individual items in the tray 10, thereby ensuring correct placement of each individual item in its appropriate location. The finished product is, accordingly, an aesthetically pleasing collection held in place by the compartments or cavities in the tray 10.

Figure 4:
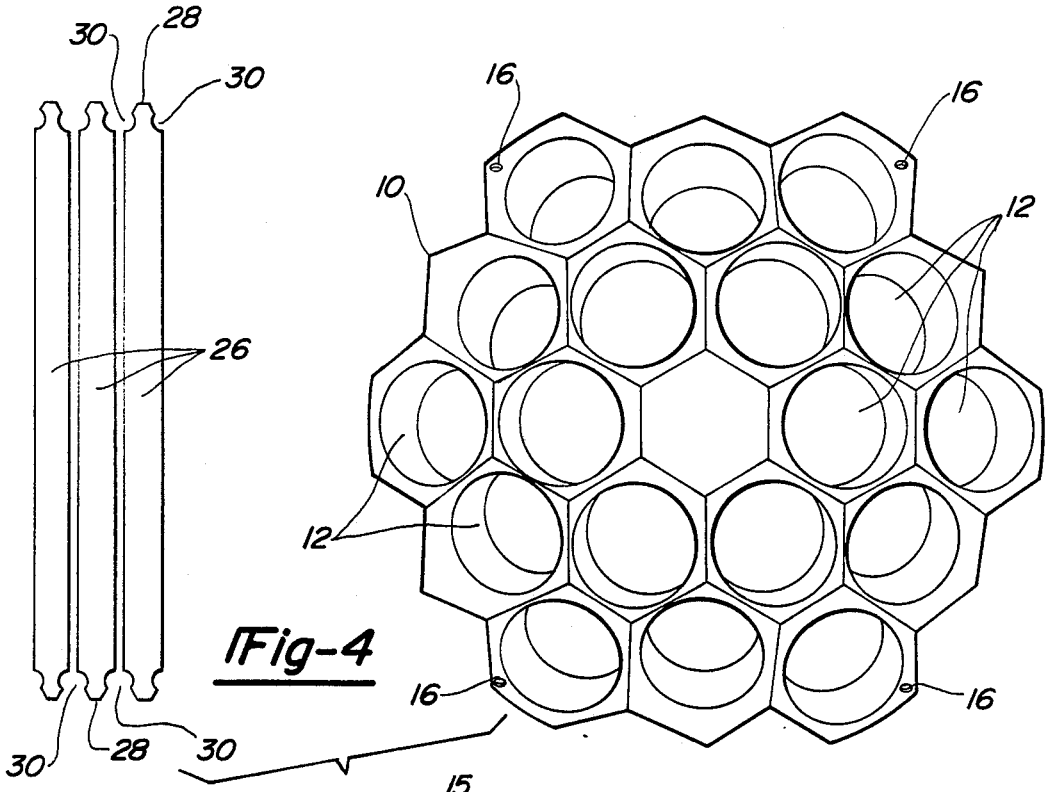
FIG. 4 is a top view of the tray portion of the invention in its preferred embodiment, prior to its assembly, together with the affixing bands used in the assembly of the tray.

Referring now to FIG. 4, the preferred embodiment of the construction of the tray can be seen in more detail. The tray 10 is manufactured from a single piece of vacuum deformable plastic, typically of a thickness of less than 1/100th of an inch. As a result, the tray is easily flexible. Further, the cavities 12 in the tray 10 are preferably disposed in a geometrically precise pattern, conducive to easy deformation of the tray. As is shown more clearly in FIG. 5, spaced equally around the perimeter of the tray are a series of slotted openings 15. The slotted openings 15 are arranged so as to assist in the deformation and positioning of the edges of the tray 10. Each tray 10 is supplied with a series of bands 26 of predetermined length. The end of each band 26 is designed with a tapered point 28, and immediately adjacent to said point a pair of indentations 30 which serve to create a narrowing at each end of each said band 26. The tapered point 28 and indentations 30 are of sufficient size to correspond to the slotted openings 15 disposed around the perimeter of the tray 10.

Figure 5:
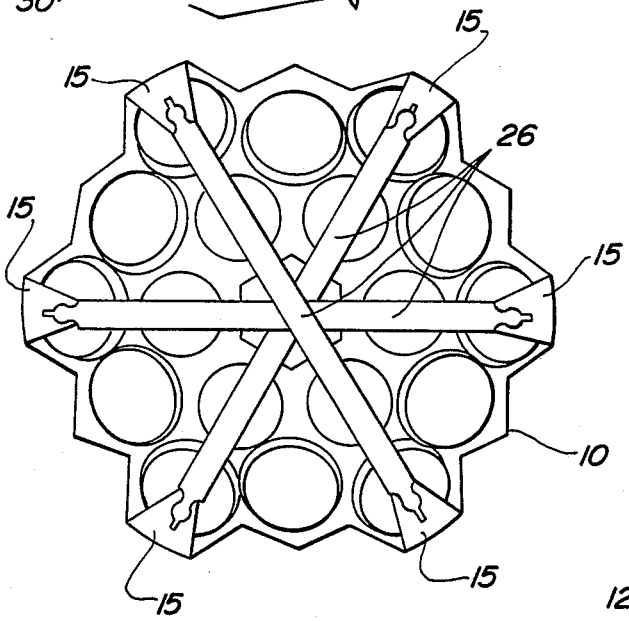
FIG. 5 is a bottom view of the invention, showing the tray with its affixing bands in position.

Referring now to FIG. 5, it can be seen that by installing one or more bands 26 in the slotted openings 15 in said tray 10, and by dimensioning said band 26 so as to correctly dimension the configuration of the tray 10, that the bands 26 will serve to contract the edges of the tray 10 toward one another, thereby causing the upper surface or the center of the tray 10 to bulge upward in a more or less spherical fashion. When viewed from the side therefore, the assembled tray 10 will present an upper surface which is approximately that of the surface of the section of a sphere.

In a second embodiment, the tray 10 can be molded out of a non-transparent plastic material in it's entirety. The series of keys 32 on which a number of symbols 34 are imprinted are still utilized. However, instead of placing the tray 10 directly on top of key 32, the key 32 is utilized as an independent reference source. Fixed key locations 16 are located on both the tray 10 and key 32. By utilizing these fixed key locations 16 as reference sites, baked goods 18 can be placed in the tray 10 in a predefined pattern by simply referring to the key 32, much as one looks at a road map. The key 32 is now an independent reference source and need not be placed in proximity to the tray 10. This is especially applicable when utilizing trays 10 which contain a relatively small number of cavities 12. It is then easy to independently reference the key 32 to the tray 10, even without the use of fixed key locations 16, as confusion is unlikely due to the small number of cavities 12.

Figure 6:
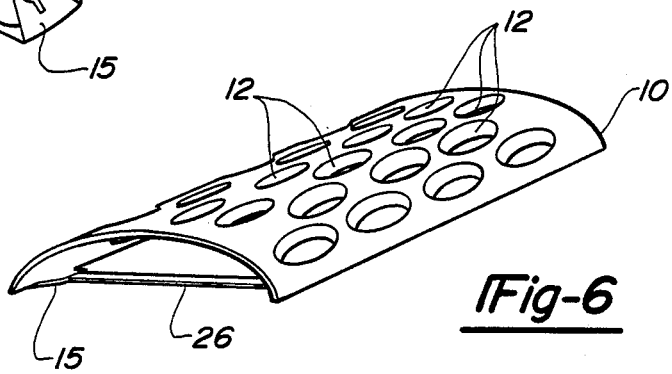
FIG. 6 is a perspective view of a second embodiment of the invention utilizing a tray of more or less rectangular shape.

In a third embodiment, referring now to FIG. 6, the tray 10 is formed in a more or less rectangular shape, and the bands 26 serve to pull the sides of the rectangle together, thereby causing the tray to bow up as shown in FIG. 6. A wide variety of alternate geometric configurations can be envisioned, without departing from the invention herein described.

Having thus disclosed my invention fully herein, the following claims to the invention are made:

I claim:

1. A tray for holding a plurality of individual confectionery items, such as cupcakes, comprising:

(a) a flexible tray;

(b) a plurality of cavities integrally formed on said tray;

(c) a plurality of attachment points disposed around the periphery of said tray; and (d) at least one flexible band having attachment means on both ends of said band for removably attaching said ends of said band to a first corresponding attachment point and a second corresponding attachment point, and each said band being of a length sufficiently less than the distance along said tray between said first and second corresponding attachment points to cause said periphery of said tray to contract whereby the center of said tray bulges upward in a generally spherical fashion.

2. The invention of claim 1, wherein:

(a) said attachment points include slotted openings; and (b) said attachment means on said at least one flexible band includes a pointed end adjacent to a narrow segment of sufficient dimensions to removably engage said slotted openings.

3. The invention of claim 1, wherein said tray is generally circular in shape.

4. The invention of claim 1, wherein said tray is generally rectangular in shape.

5. The invention of claim 1, wherein said tray is generally transparent in those portions that correspond to the bottom of said cavities and further comprising a coded key having a plurality of discrete coded positions predeterminatively oriented beneath said tray delineating a predetermined pattern by said coded positions visible to the human eye through said transparent portions of said cavities of said tray when viewed from above.

6. The invention of claim 1, wherein said tray is generally opaque in its entirety.

7. The invention of claim 5 wherein a collection of instructions correlates said confectionery items to said coded positions, whereby a predetermined pattern of said confectionery items is delineated in said cavities on said tray.

* * * * *